United States Patent [19]

Knight

[11] 4,164,356

[45] Aug. 14, 1979

[54] CHAIR

[76] Inventor: Richard G. Knight, 155 Wimbleton, Birmingham, Mich. 48008

[21] Appl. No.: 861,995

[22] Filed: Dec. 19, 1977

[51] Int. Cl.[2] ..... A47C 3/00

[52] U.S. Cl. ..... 297/1; 297/456; 297/457

[58] Field of Search ..... 297/1, 2, 3, 457, 456, 297/455, 452, 295, 294, 284

[56] References Cited

U.S. PATENT DOCUMENTS

| | | | |
|---|---|---|---|
| 229,233 | 6/1880 | Behr | 297/1 |
| 2,429,939 | 10/1947 | Masterson et al. | 297/1 X |
| 2,487,907 | 11/1949 | Turner | 297/457 |
| 2,557,671 | 6/1951 | McDonald | 297/299 X |
| 2,708,960 | 5/1955 | Shephard | 297/456 X |
| 3,024,068 | 3/1962 | Eames | 297/455 |
| 3,610,685 | 10/1971 | Lay | 297/452 X |
| 3,677,601 | 7/1972 | Morrison et al. | 297/456 |
| 3,877,750 | 4/1975 | Scholpp | 297/284 |

FOREIGN PATENT DOCUMENTS

| | | | |
|---|---|---|---|
| 134596 | 4/1933 | Austria | 297/295 |
| 54112 | 3/1943 | Netherlands | 297/295 |
| 199740 | 11/1938 | Switzerland | 297/1 |

*Primary Examiner*—Francis K. Zugel
*Attorney, Agent, or Firm*—Basile and Weintraub

[57] ABSTRACT

A chair comprising a pair of multi-angled frame members disposed substantially parallel to and spaced from one another. The frame members each define a leg for supporting the frame members in an upright position. The chair includes a flexible cushion having first and second end sections pivotally supported by the frame members, the pivotal connection being such as to permit relative movement between the cushion ends and the supporting frame members. The connection includes a friction-tight bearing which restricts the pivotal movement. The cushion is disposed along a curved path to define a seat and comprises the first and second end sections which are connected by a plurality of cushioned, intermediate, rigid sections interconnected by flexible material to permit relative pivotal movement between the intermediate sections and the associated end sections. Two embodiments of the present invention are disclosed including single-position and multiple-position chairs.

1 Claim, 5 Drawing Figures

FIG - 1
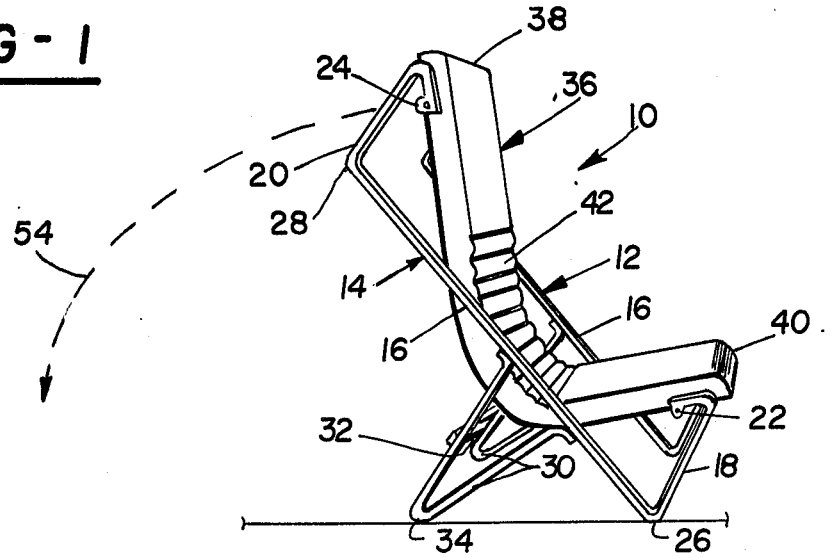
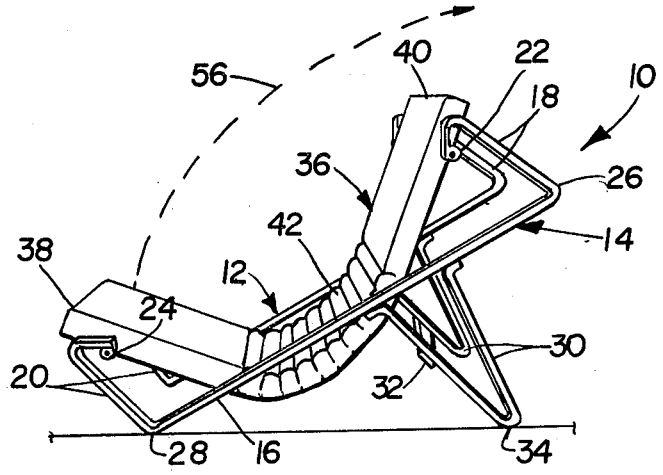
FIG - 2

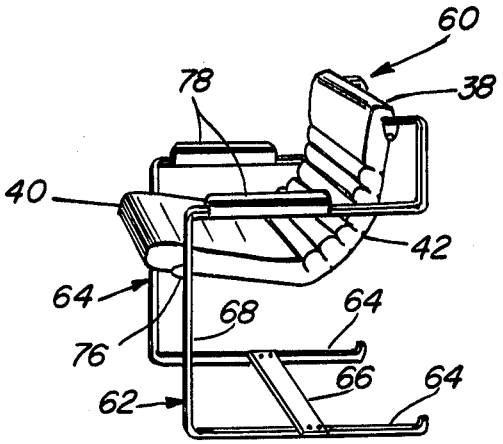
FIG-3
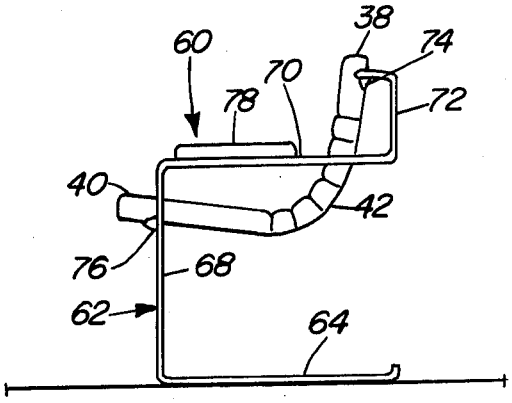
FIG-4
FIG-5
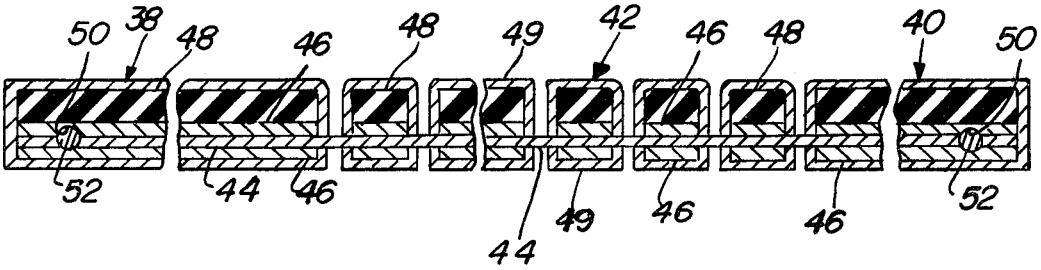

CHAIR

BACKGROUND OF THE INVENTION

1. Field of the Invention

The present invention relates to a chair having means for mounting a flexible cushion to define a seat and, in particular, to single- and multiple-position chairs.

2. Description of the Prior Art

The prior art discloses numerous chair constructions including structures that comprise a pair of frame members that are disposed at substantially parallel and laterally spaced relationship to define a means for supporting thereinbetween a supporting section that defines a seat. Chairs and similar articles of manufacture which relate to applicant's invention are disclosed in U.S. Pat. Nos. 59,403; 191,733; 229,233; 2,843,181; and 3,121,587. Each of the aforementioned patents discloses spaced parallel frame members of varying configurations adapted to support rigid and/or flexible seat supporting members which adapt the chair for use in either single or multiple positions and are therefore relevant to applicant's invention. None, however, disclose the unique structure for a chair utilizing a flexible cushion which is adapted for use in either single- or multiple-position chairs.

3. Prior Art Statement

In the opinion of applicant and applicant's attorney the aforementioned prior art represents the closest prior art of which the applicant and applicant's attorney are aware.

SUMMARY OF THE INVENTION

The present invention, which will be described subsequently in greater detail, comprises a chair having a pair of multi-angled frame members disposed substantially parallel and laterally spaced from each other and defining legs for supporting the frame members in an upright position. The chair comprises a flexible cushion having first and second end sections respectively supported at spaced locations on the frame members so as to position the cushion along a curved path to define a seat for supporting a person. The cushion comprises the first and second end sections pivotally secured to the frame members and a plurality of cushioned, intermediate, rigid sections interconnected by flexible material which permits relative pivotal movement between the intermediate sections and the end sections of the cushion to facilitate the positioning of the cushion along a plurality of curved paths. In one embodiment of the invention the chair has one pair of fixed legs to support the chair in one upright position, and in a second embodiment of the invention the chair is provided with a plurality of legs at spaced locations which facilitates the multiple positioning of the chair to permit the use of the chair in different positions.

It is therefore a primary object of the present invention to provide a new and improved chair having a flexible cushion disposed along a curved path to define a seat for supporting a person.

It is a further object of the present invention to provide a new and improved chair employing a flexible cushion.

It is a further object of the present invention to provide a chair employing a flexible cushion wherein the chair is of the multiple-position type.

It is a further object of the present invention to provide a chair of the type disclosed which is of a simple design and, thus, inexpensive to construct, but reliable in use.

Other objects, advantages and applications of the present invention will become apparent to those skilled in the art of chair construction when the accompanying description of several examples of the best modes of applicant's invention is read in conjunction with the accompanying drawings.

BRIEF DESCRIPTION OF THE DRAWINGS

The description makes reference to the accompanying drawings wherein like reference numerals refer to like parts throughout the several views, and wherein:

FIG. 1 is a perspective side view of a multiple-position chair, the chair being illustrated in the first position;

FIG. 2 is a perspective side view of the multiple-position chair illustrated in FIG. 1 with the chair being illustrated in a second position;

FIG. 3 is a side elevational view of a second form of applicant's invention in the form of a chair having a flexible cushion;

FIG. 4 is a side elevational view of the chair illustrated in FIG. 3; and FIG. 5 is a fragmentary, longitudinal, sectional view through the flexible cushion illustrated in FIGS. 1 and 3 of the drawings.

DESCRIPTION OF THE PREFERRED EMBODIMENTS

Referring now to the drawings to FIGS. 1 and 2, there is illustrated one example of the present invention in the form of a multiple-position chair 10. The chair 10 comprises a pair of substantially parallel and laterally spaced frame members 12 and 14. The frame members 12 and 14 are fabricated from strong, rigid members preferably made of a metal, such as tubular and/or bar stock material; however, suitable plastic materials may be utilized in the construction of the frame members 12 and 14. Each frame member 12 and 14 includes a body 16 having inclined legs 18 and 20, each of which has bent ends that terminate in supporting hinge sections 22 and 24, respectively. The juncture of the body 16 with the legs 18 and 20 defines feet 26 and 28 which are adapted to engage the floor in a supporting manner, as will be described hereinafter. The frame members 12 and 14 further comprise a pair of intermediate legs 30 in the form of V-shaped members which have their extended ends attached to the underside of the frame body 14 by any suitable means, such as by welding or the like. The side edges of the V-shaped legs 30 are connected by a base member 32. The base member 32 in conjunction with support rod 52, to be described hereinafter, functions to maintain the frame members 12 and 14 in the substantially parallel and laterally spaced relationship. The apexes of the V-shaped members 30 define supporting feet 34 which in conjunction selectively with the supporting feet 26 and 28 provide means to support the chair in one of a plurality of selected positions.

As can best be seen in FIG. 5, the chair includes a cushion 36 which comprises a top end section 38 and a lower end section 40 interconnected by a plurality of intermediate sections 42. Each of the sections comprises an elongated, flexible member 44 fabricated from a material which is of sufficient strength to support a person sitting on the chair 10. Selected materials, such as canvas or suitable plastic materials, may be sufficient to provide the desired flexibility and strength. The flexible member 44 is sandwiched between pairs of rigid members 46 at selected points alsong the entire length of the flexible member 44. The larger rigid members 46 at the opposite ends of the flexible member 44 define the interiors of the end sections 38 and 40, while the intermediate portions of the rigid members 46 between the end sections 38 and 40 define the intermediate sections 42. The rigid sections 46 may be fabricated from suitable materials, such as plywood, hard plastic and the like. The top side of the rigid sections 46 have a cushion material 48 attached thereto. The cushion material may be a foam rubber or the like which is attached to the exposed surface of the rigid member 46 by any suitable means, preferably by an adhesive. The rigid sections 46 and the associated cushion material 48 associated therewith are covered by a suitable protective material 49, such as a plastic laminate or a cloth laminate or a fabric, as desired, for both protection and aesthetic purposes, as well as for providing strength to the cushion 36.

As can best be seen in FIG. 5, the end sections 38 and 40 are each provided with an aperture 50 through which a support rod 52 extends. The support rods 52 are carried by the hinge members 22 and 24 formed at the opposite ends of the body legs 18 and 20. The hinge members 22 and 24 receive the opposite ends of the support rods 52 in a snug relationship to provide a friction bearing restraining the rapidly turning motion of the support rods 52 with respect to the hinge members 22 and 24. This retards rapid rotational movement of the end sections 38 and 40 with respect to the opposite hinge members 22 and 24 and insures the safe seating of a person on the chair 10. The connection of the cushion to the frame members 12 and 14 may be accomplished by having the support rods 52 securely attached within the apertures 50 in the end sections 38 and 40, while providing for relative pivotal movement between the opposite ends of the support rods 52 and suitable apertures within the hinge members 22 and 24. Alternately, the connection between the opposite ends of the support rods 52 and suitable apertures in the hinge means 22 and 24 may be of a fixed, rigid, non-rotating type, while relative rotational movement occurs between the end sections 38 and 40 and their respective support rods 52.

As can best be seen in FIG. 1 of the drawings, the chair 10 is illustrated in one of its multiple positions with the feet 34 being positioned on the floor, while the forward feet 26 are also positioned on the floor, providing an upright positioning of the frame members 12 and 14. Since the hinge section 22 and 24 are positioned with respect to each other at a distance that is less than the distance along the length of the cushion 36, the cushion 36 must necessarily follow a curved path and define a seat which will receive and support a person. By rotating the chair 10 about its support feet 34 in the direction of the arrow 54 to a position wherein the support feet 26 are raised from the floor and the support feet 28 engage the floor as shown in FIG. 2 of the drawings, the multiple-position chair 10 assumes a second of its multiple positions. The cushion 36 is now disposed along a different curved path adapted to define a seat to receive and support a person. By rotating the chair 10 clockwise in the direction of the arrow 56 about the support feet 34, the chair 10 may be moved back to the position illustrated in FIG. 1 of the drawings.

Referring now to FIGS. 3 and 4 of the drawings for a description of a second embodiment of the present invention in the form of a chair 60 which comprises a pair of substantially parallel and laterally spaced angled frame members 62 that include legs 64 interconnected by a base member 66 which, in conjunction with the support rods 52, functions to maintain the frames 62 in the laterally spaced, parallel relationship. Each frame 62 defines a generally inverted "S" shape having an upright member 68, a horizontal arm 70, an upright back portion 72 and hinge means 74 which receives the supporting rod 52 carried in the upper support top end section 38. The upright member 68 includes an intermediate section defining a hinge means 76 which has a suitable aperture for receiving the opposite ends of the support rod 52 carried in the lower end section 40 of the cushion 36. Since the lineal distance between the hinge means 74 and 76 is less than the length of the cushion, the cushion 36 must necessarily follow a curved path to define a seat to receive and support a person. In the same manner as aforementioned, the relative pivotal movement between the cushion and the hinge means 74 and 76 is retarded so as to provide for a safe amount of pivotal movement to permit the safe seating of a person thereon. The arms 70 are each provided with cushion members 78 to provide additional comfort in using the inventive chair 60.

It can thus be seen that applicant has disclosed a unique and novel chair having a cushion construction which permits the use of the cushion in a plurality of arrangements including single-position and multiple-position chairs wherein the cushion is positioned along one of a plurality of curved paths to define a seat to receive and support a person.

It should be understood by those skilled in the art of chair construction that other forms of applicant's invention may be had, all coming within the spirit of the invention and the scope of the appended claims.

What is claimed is as follows:

1. A chair comprising:

a pair of multi-angled, C-shaped frame members disposed substantially parallel to and laterally spaced from each other, one end section of each of said frame members defining a leg which cooperates to form a first pair of legs for supporting the frame members in an upright position;

the other end of each of said frame members defining a second leg which cooperates to form a second pair of legs longitudinally spaced from said first pair of legs and adapted to support said frame members in a second position;

an intermediate pair of legs carried by said frame members at a position between said first pair of legs and said second pair of legs and at a position closer to said first pair of legs such that said chair may be positioned on said first pair of legs and said intermediate pair of legs in a first position to receive and support a person, said chair being rotatable about said intermediate legs to said second position wherein said chair is supported on said second pair of legs;

a base member rigidly connecting said intermediate pair of legs;

a pair of hinge members extending between the opposite ends of said C-shaped frame members and supported thereby, said hinge members maintaining said frame members in said spaced relationship;

a flexible cushion having a first end section pivotally supported by one of said hinge members and a second end section pivotally supported by the other of said hinge members, the distance between said hinge members being less than the distance between said cushion end sections such that said cushion is disposed along a curved path to define a seat, said cushion comprising said first and second end sections and a plurality of cushioned, intermediate, rigid sections interconnected by a flexible material to permit relative, pivotal movement between said intermediate sections and said end sections;

said cushion being disposed along different curved paths when said chair is supported in said two positions, said cushion further comprising:

an elongated, flexible member extending from said first and second end sections;

a plurality of rigid sections carried on one side of said flexible members at spaced locations;

a plurality of cushion members carried by said rigid members;

a laminate enclosing said rigid sections and said cushion sections, the intermediate sections between said first and second end sections having a length which is substantially less than the length of said end sections such that there is relative pivotal movement between said intermediate sections and said end sections so as to permit said cushion member to be shaped along a curved path; and means restraining relative pivotal movement between said frame members and said end sections.

* * * * *